United States Patent [19]

Gowers

[11] Patent Number: 4,462,284

[45] Date of Patent: Jul. 31, 1984

[54] TOOL EXTENSION

[76] Inventor: Ronald B. Gowers, 1938 N. 1690 West, Layton, Utah 84041

[21] Appl. No.: 459,154

[22] Filed: Jan. 19, 1983

[51] Int. Cl.[3] ..... B25B 7/02

[52] U.S. Cl. ..... 81/428 R; 81/367

[58] Field of Search ..... 81/180 R, 428 R, 300, 81/53, 54, 367, 342–348, 381–385

[56] References Cited

U.S. PATENT DOCUMENTS

| | | | |
|---|---|---|---|
| 421,688 | 2/1890 | Fisher . | |
| 1,412,205 | 4/1922 | Fisher | 81/177 A |
| 1,460,294 | 6/1923 | Wegner . | |
| 1,733,642 | 10/1929 | Beduorz . | |
| 2,563,267 | 8/1951 | Petersen | 81/186 |
| 3,188,602 | 6/1965 | Toedtman et al. | 81/53 R |
| 3,691,877 | 9/1972 | Harris | 81/177 A |

FOREIGN PATENT DOCUMENTS

| | | | |
|---|---|---|---|
| 486757 | 11/1929 | Fed. Rep. of Germany | 81/53 R |

*Primary Examiner*—James L. Jones, Jr.

*Attorney, Agent, or Firm*—Donald J. Singer; Bobby D. Scearce

[57] ABSTRACT

A novel tool extension, adaptable to hand tools of the pivotal jaw type, is provided, which comprises, a first rod pivotally connected to one handle of the tool, a connecting plate attached to the second handle of the tool, a lever arm pivotally connected at one end to the connecting plate and at the other end to a second rod, the rods being restrained for closely spaced relatively parallel movement in a plane substantially parallel to the plane defined by the tool handles. The tool handles are actuated by relative axial movement of the rods.

11 Claims, 4 Drawing Figures

TOOL EXTENSION

RIGHTS OF THE GOVERNMENT

The invention described herein may be manufactured and used by or for the Government of the United States for all governmental purposes without the payment of any royalty.

BACKGROUND OF THE INVENTION

This invention relates generally to the field of extension handles and remote actuating mechanisms for small hand tools, and more particularly a novel long-handled extension and actuating mechanism for tools having pivoted jaws.

Tool extensions of conventional design have been developed and used in order to provide means to position and use a tool in spaces relatively inaccesible manually, and have included extension handles of various designs for use with wrenches and the like for reaching work pieces. Conventional tool extensions and operating handles have not been found to be satisfactory for use with tools having pivoted jaws, since conventional tool extensions are unsuitable to remotely position and actuate these kinds of tools.

The present invention provides a novel tool extension and actuating mechanism particularly adaptable to tools of the pivotal jaw type, such as pliers, Vise-grips ®, and the like. The tool extension of the present invention provides the means for reaching bolts and the like situated in limited access areas not otherwise reachable manually. Particular utility for the invention was found through adaptation to a pair of Vise-grips ® modified by welding to the handles thereof means for attachment to the tool extension of this invention. Blind type fastenings including bolts located in the interior of aircraft wings could be reached for replacement without removal of other aircraft parts to allow access thereto.

The invention comprises a pair of long rods, one of which is pivotally attached to one handle of the Vise-grip ® tool. The other rod is pivotally interconnected to the second handle of the Vise-grip ® tool through a slotted lever and attaching plate. The tool extension allows positioning of the Vise-grip ® tool at a bolt and actuating the jaws of the Vise-grips ® to firmly grip the bolt between the jaws.

It is, therefore, a principal object of the present invention to provide a tool extension adaptable to pivotal jaw type hand tools.

It is a further object of the invention to provide a tool extension including means to actuate the tool remotely.

These and other objects of the present invention will become apparent as the detailed description of certain representative embodiments thereof proceeds.

SUMMARY OF THE INVENTION

In accordance with the foregoing principles and objects of the present invention, a novel tool extension, adaptable to hand tools of the pivotal jaw type, is provided, which comprises, a first rod pivotally connected to one handle of the tool, a connecting plate attached to the second handle of the tool, a lever arm pivotally connected at one end to the connecting plate and at the other end to a second rod, the rods being restrained for closely spaced relative parallel movement in a plane substantially parallel to the plane defined by the tool handles. The tool handles are actuated by relative axial movement of the rods.

DESCRIPTION OF THE DRAWINGS

The present invention will be more clearly understood from the following detailed description of specific representative embodiments thereof read in conjunction with the accompanying drawings wherein.

DETAILED DESCRIPTION

Figure 1:
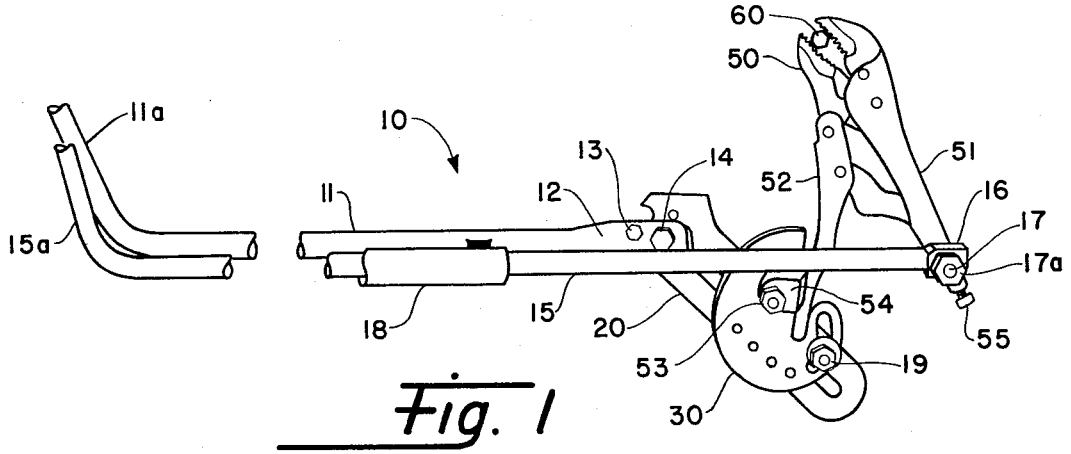
FIG. 1 is a perspective drawing of the tool extension of the present invention assembled with a typical tool suitable for use with the invention.

Referring now to the drawings, FIG. 1 shows a perspective view of the tool extension assembly 10 of the present invention with an attached tool 50. The embodiment of the tool extension 10 of the present invention as depicted in FIG. 1 is shown attached to a conventional tool 50, commonly referred to as Vise-grip ® , with which the invention herein described was found to be particularly useful. It is understood however that, as will be apparent upon a reading hereof, a variety of tools having a scissor or pivotal type action with a pair of confronting gripping jaws, such as pliers or the like, may also be adaptable for use with the tool extension of the present invention.

Tool extension 10 comprises, in a preferred embodiment, an extension handle or rod 11 terminating at one end thereof with a grip **11*a* and at the other end with a flattened portion in the form of a joining plate 12 having two holes for receiving bolts 13 and 14 for joining to lever member 20 as hereinafter described. A second extension handle or rod 15 terminates at one end thereof with a grip 15*a* and has a joining plate or eyelet 16 at the other end thereof for receiving a bolt 17 welded to handle 51 of tool 50, and held in place with a mating nut 17*a*. A tubular guide 18 of sufficient inside diameter to slideably receive rod 15 is attached, as by welding, in juxtaposition to extension rod 11 and restrains extension rod 15 in a close parallel relationship to extension rod 11, while allowing relative parallel movement of rods 11, 15**.

Figure 4:
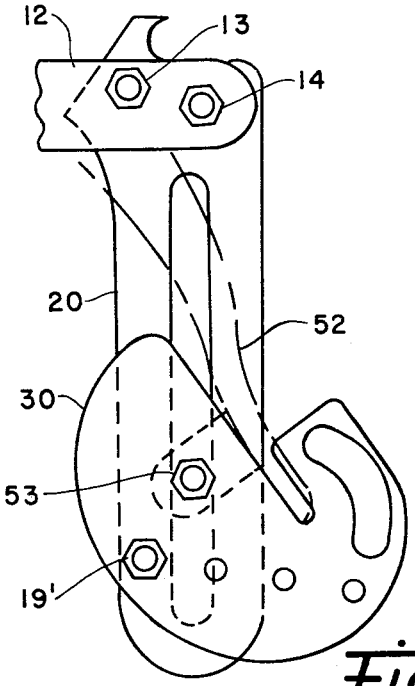
FIG. 4 shows a partial view of the tool extension in an assembly arrangement alternative to that suggested in FIG. 1.
Figure 2:
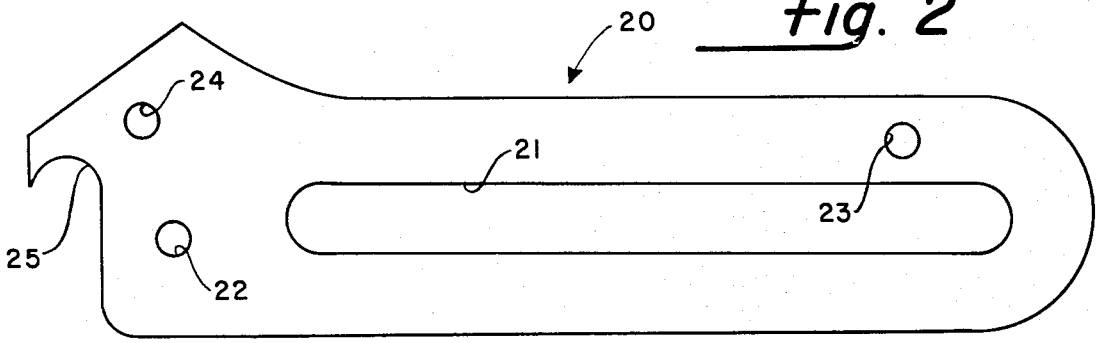
FIG. 2 is a plan view substantially to scale of the lever member of the present invention.

Referring now to FIG. 2, presented therein is a plan view, substantially to scale, of the lever member 20 shown in the assembly 10 of FIG. 1. Lever 20 has overall dimensions of about 2 inches by 7 inches and is fabricated in the shape suggested in FIG. 2 of plate stock, about 0.200 inch thick, of suitable metal such as aluminum, steel or the like. It is understood that the overall shape, size and material of construction of lever 20 and of attaching plate 30 hereinafter described is not critical to the invention herein except that they shall have suitable shape and design to perform their respective functions hereinafter described as part of tool extension 10. Lever 20 includes along a substantial portion of its length a centrally located slot 21. A hole 22 is provided as shown for receiving bolt 14 for pivotal attachment of extension rod 11 for the configuration shown in FIG. 1. Hole 23 is positioned to receive a bolt 19 for attaching plate 30 as hereinafter described. A hole 24 is positioned as shown near hole 22 at one end of lever 20 for receiving bolt 13 for substantial rigid attachment of extension rod 11 in the alternative configuration presented in FIG. 4. An arcuate recess 25 is machined substantially as shown at the end of lever 20 containing holes 22 and 24 to provide a pivotal stop to bolt 13 for the configuration as presented in FIG. 1.

Figure 3:
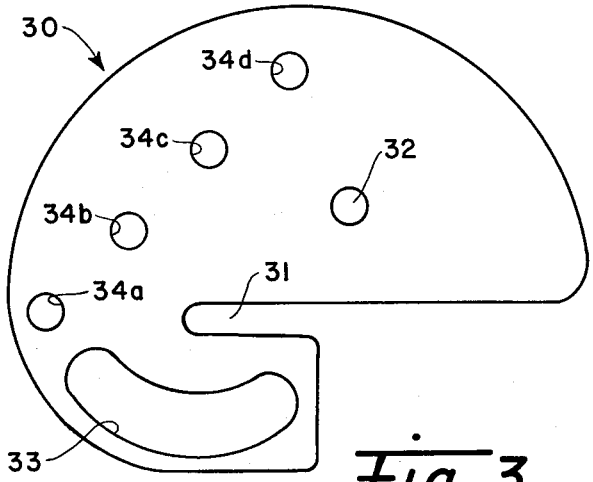
FIG. 3 is a plan view substantially to scale of the attaching plate.

FIG. 3 shows attaching plate 30 substantially to scale. Plate 30 includes a slot 31 for receiving the second handle 52 of tool 50, and a centrally located attaching hole 32 for receiving an attaching bolt 53 for securing handle 52 to plate 30. An arcuate slot 33 is provided on one side of plate 30 for adjustable pivotal attachment of plate 30 to lever 20 in one assembly configuration of the present invention as shown in FIG. 1. A plurality of positioning holes 34 are provided along the other side of plate 30 in a predetermined array for selective pivotal attachment to lever 20 in the FIG. 4 assembly configuration.

Referring again to FIG. 1, extension rod 11 may, in one assembly configuration of the tool extension 10, be pivotally attached to lever 20 at hole 22 using bolt 14. Lever 20 is attached in a desired orientation to attaching plate 30 by a bolt 19 extending through hole 23 (of lever 20) and arcuate slot 33 (of plate 30) and secured by a washer and nut 19. Handle 52 of tool 50 has an attaching plate, yoke or eyelet 54 welded thereto at a suitable locus near the end thereof such that handle 52 may be received by slot 31 of plate 30 and held rigidly therein by bolt 53 through eyelet 54 and hole 32 of plate 30.

Operation of the tool extension 10 as adapted to a Vise-grip® tool 50 in the configuration as depicted in FIG. 1 may be summarized as follows.

A bolt 60 may be assumed to be positioned remotely and sought to be reached and clamped upon using tool 50. First, therefore, the closed position of Vise-grip® tool 50 may be adjusted according to the size of bolt 60 by suitable adjustments of the jaw spacing of tool 50 by suitable adjustment of thumb screw 55. Secondly, and considering the location of bolt 60 sought to be reached and its accessibility relative to the linkage assembly comprising lever 20 and plate 30, suitable adjustments of plate 30 to lever 20 are made by positioning bolt 19 suitably within slot 33 and tightening; this procedure approximates a configuration of the tool extension 10 and tool 50 needed to suitably reach bolt 60. Once the tool extension 10 adjustments are made and suitable spacing of the jaws of tool 50 is set to conform to the location and size of bolt 60, the extension 10 with tool 50 attached may be inserted into the remote space where bolt 60 is located with the jaws of tool 50 positioned therearound. Tool 50 is then actuated to clamp firmly onto bolt 60 by moving extension rods 11, 15 relative to each other. Therefore, by pulling on extension rod 15 and/or pushing on extension rod 11, handle 52 of tool 50 will be rotated to a closed position, thereby clamping bolt 60 between the jaws of tool 50.

The assembly configuration presented in FIG. 1 is suitable for reaching bolts 60 whose location relative to the linkage (lever 20 and plate 30) of tool extension 10 is beside or beyond an accessible location for the linkage. In some situations the location of bolt 60 is such that the linkage mechanism needs to be inserted beyond the location of the bolt and tool 50 configured to extend backwardly to the bolt 60 position. In this situation lever 20 and plate 30, extension rod 11 and tool 50 are assembled in the configuration presented in FIG. 4. As shown therein lever 20 is inverted relative to the assembly configuration presented in FIG. 1. Extension rod 11 is then rigidly bolted to lever 20 using bolts 13 and 14 inserted through, respectively, holes 24 and 22 in one end of lever 20. Tool 50 is then bolted to plate 30 in essentially the same configuration as suggested in FIG. 1. Depending then upon the desired orientation of tool 50 relative to extension 10, an appropriate positioning hole 34 is selected through which plate 30 is bolted to lever 20 using a bolt 19', such that one end of bolt 53 holding handle 52 of tool 50 to plate 30 may serve as a bushing riding in slot 21 of lever 20. The tool extension 10 with tool 50 attached is then actuated in manner substantially similar to that just described for the configuration presented in FIG. 1.

Therefore, the tool extension 10 with tool 50 attached may be used in combination to reach and grip a bolt 60 in virtually any location relative to tool extension 10. Tool 50 may be orientated relative to tool extension 10 from a small angle wherein tool 50 is pointed substantially toward the operator of the tool extension, to a large angle wherein tool 50 is pointed substantially away from the operator.

It is clear that in the practice of the invention described herein, the size and shapes of lever 20 and plate 30 comprising the linkage assembly of tool extension 10 may be varied within the scope of the teachings herein so long as they perform the pivotal action described herein to actuate tool 50. It is therefore understood that certain modifications to the tool extension 10 described may be made as might occur to one with skill in the field of this invention within the scope of the appended claims. Therefore, all embodiments contemplated hereunder have not shown in complete detail. Other embodiments may be developed without departing from the spirit of this invention or from the scope of the appended claims.

I claim:

1. A tool extension for remote operation of a tool having a pair of pivoted jaws and a pair of handles operatively connected to said jaws, comprising:

a. a first rod pivotally connected at one end thereof to a first said handle of said tool, for remote movement of said first handle by movement of said rod along a direction parallel to its length;

b. a lever;

c. a connecting plate attached to the second said handle, substantially in a plane defined by said handles, said connecting plate pivotally connected to a first end of said lever at a location eccentric to the location of attachment of said second handle;

d. a second rod pivotally connected to the second end of said lever; and e. means for restraining said first and second rods to closely spaced relative parallel movement along respective directions substantially parallel to said plane.

2. A tool extension as recited in claim 1 wherein said connecting plate includes an arcuate slot for adjustably positioning the location of the pivotal connection of said first end of said lever.

3. A tool extension as recited in claim 1 wherein said lever includes a pivotal stop near said second end to limit the pivotal movement of said second rod relative thereto.

4. A tool extension as recited in claim 1 wherein said restraining means for said rods comprises a tubular member attached in juxtaposition to one of said rods and the other said rod is slideably received within said tubular member.

5. A tool extension for remote operation of a tool having a pair of pivoted jaws and a pair of handles operatively connected to said jaws, comprising:

a. a first rod pivotally connected at one end thereof to a first said handle of said tool, for remote movement of said first handle by movement of said rod along a direction parallel to its length; P1 b. a lever;

c. a connecting plate attached to the second said handle, substantially in a plane defined by said handles, said connecting plate pivotally connected to a first end of said lever at a location eccentric to the location of attachment of said second handle;

d. a projecting bushing attached to said connecting plate near said location of attachment of said second handle;

e. means defining a central guide slot in said lever for slideably receiving said bushing;

f. a second rod rigidly attached to the second end of said lever; and g. means for restraining said first and second rods to closely spaced relative parallel movement along respective directions substantially parallel to said plane.

6. A tool extension as recited in claim 5 wherein said restraining means for said rods comprises a tubular member attached in juxtaposition to one of said rods and the other said rod is slideably received within said tubular member.

7. An improved tool, comprising, in combination:

a. a hand tool including a pair of pivoted jaws having confronting gripping jaw faces, and a pair of handles operatively connected to said pivoted jaws;

b. a first rod pivotally connected at one end thereof to a first said handle of said tool, for remote movement of said first handle by movement of said rod along a direction parallel to its length;

c. a lever;

d. a connecting plate attached to the second said handle, substantially in a plane defined by said handles, said connecting plate pivotally connected to a first end of said lever at a location eccentric to the location of attachment of said second handle;

e. a second rod pivotally connected to the second end of said lever; and f. means for restraining said first and second rods to closely spaced relative parallel movement along respective directions substantially parallel to said plane.

8. The tool as recited in claim 7 wherein said connecting plate includes an arcuate slot for adjustably positioning the location of pivotal connection of said first end of said lever.

9. The tool as recited in claim 7 wherein said restraining means for said rods comprises a tubular member attached in juxtaposition to one of said rods and the other said rod is slideably received within said tubular member.

10. An improved tool comprising, in combination;

a. a hand tool including a pair of pivoted jaws having confronting gripping jaw faces, and a pair of handles operatively connected to said pivoted jaws;

b. a first rod pivotally connected at one end thereof to a first said handle of said tool, for remote movement of said first handle by movement of said rod along a direction parallel to its length;

c. a lever;

d. a connecting plate attached to the second said handle, substantially in a plane defined by said handles, said connecting plate pivotally connected to a first end of said lever at a location eccentric to the location of attachment of said second handle;

e. a projecting bushing attached to said connecting plate near said location of attachment of said second handle;

f. means defining a central guide slot in said lever for slideably receiving said bushing;

g. a second rod rigidly attached to the second end of said lever; and h. means for restraining said first and second rods to closely spaced relative parallel movement along respective directions substantially parallel to said plane.

11. The tool as recited in claim 10 wherein said restraining means for said rods comprises a tubular member attached in juxtaposition to one of said rods and the other said rod is slideably received within said tubular member.

* * * * *